US005283994A

United States Patent [19]

Callison

[11] Patent Number: 5,283,994

[45] Date of Patent: Feb. 8, 1994

[54] LANDSCAPE TIMBER SYSTEM

[75] Inventor: Douglas A. Callison, Des Moines, Iowa

[73] Assignee: Callison & Associates XXI, Inc., Des Moines, Iowa

[21] Appl. No.: 901,494

[22] Filed: Jun. 19, 1992

[51] Int. Cl.[5] ..... E02D 27/00; E04B 1/344

[52] U.S. Cl. ..... 52/71; 52/102; 52/233; 404/7; 47/33

[58] Field of Search ..... 405/284, 405/286; 52/102, 74, 585, 233, 284/285, DIG. 2; 47/33; 404/7

[56] References Cited

U.S. PATENT DOCUMENTS 682,312 9/1901 Zwicker ..... 52/285.4
3,545,128 12/1970 Fontaine et al. ..... 52/585
4,834,585 5/1989 Hasenwinkle ..... 52/233
4,982,535 1/1991 Pickett ..... 52/71
5,046,898 9/1991 McKinney ..... 405/286
5,178,492 1/1993 Meheen ..... 405/286

FOREIGN PATENT DOCUMENTS 541979 10/1955 Belgium ..... 52/284

*Primary Examiner*—James L. Ridgill, Jr.
*Attorney, Agent, or Firm*—G. Brian Pingel

[57] ABSTRACT

A modular landscape timber system used generally to construct retaining walls and boxed gardens having a plurality of vertically aligned layers of modular first members having ends with ball and socket joint portions that interfit with one another, a plurality of braces, and a plurality of spikes that are driven through the braces on an incline to fasten the ends of the timber members together with a resulting joint that resists rotational movement. The system further includes a deadman joint that serves to maintain the vertical alignment of the layers of first members.

12 Claims, 2 Drawing Sheets

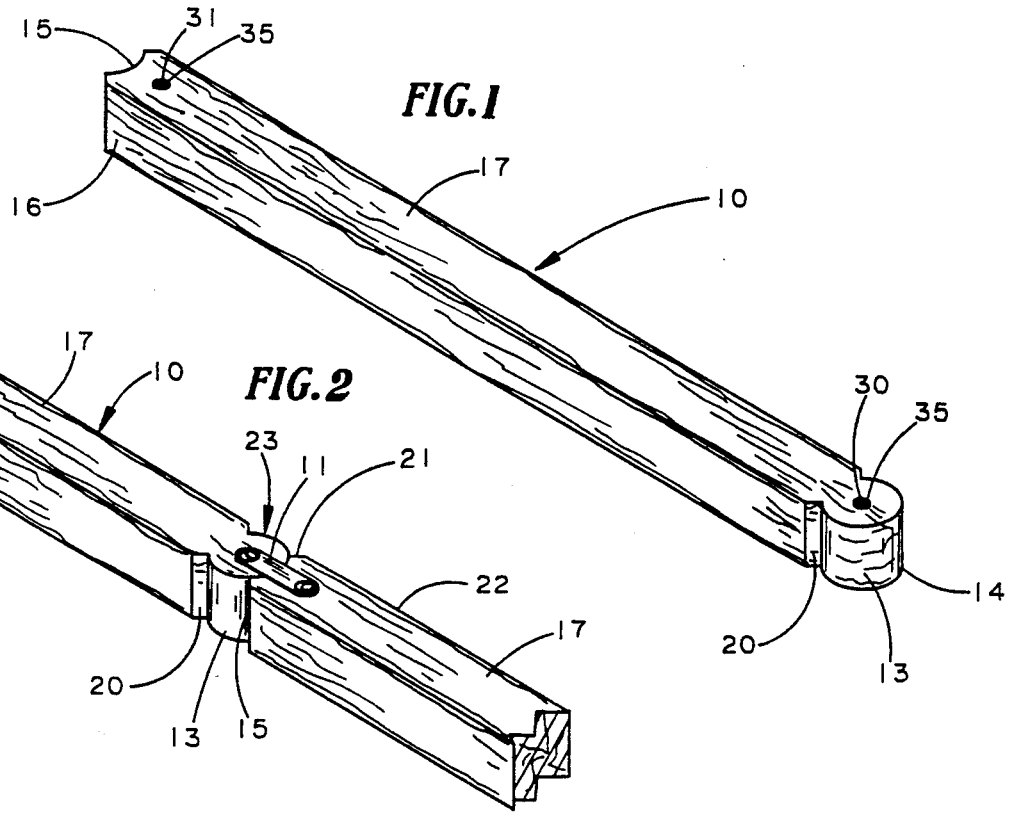
FIG.1
15
31
35
16
17
10
30
35
14
20
13
FIG.2
17
10
23
11
21
22
17
20
13
15
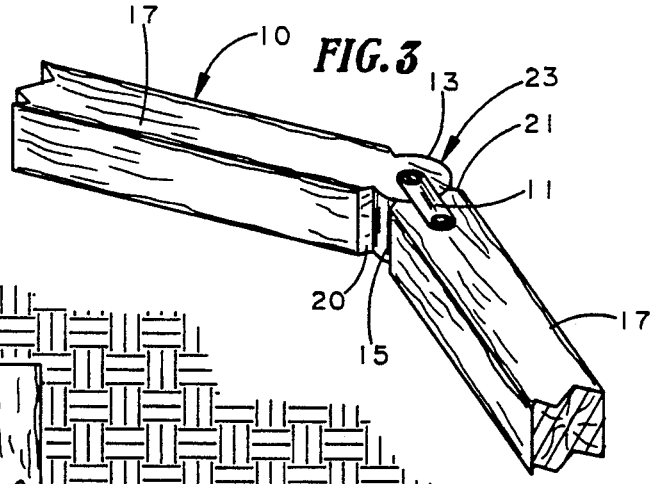
FIG.3
17
10
13
23
21
11
20
15
17
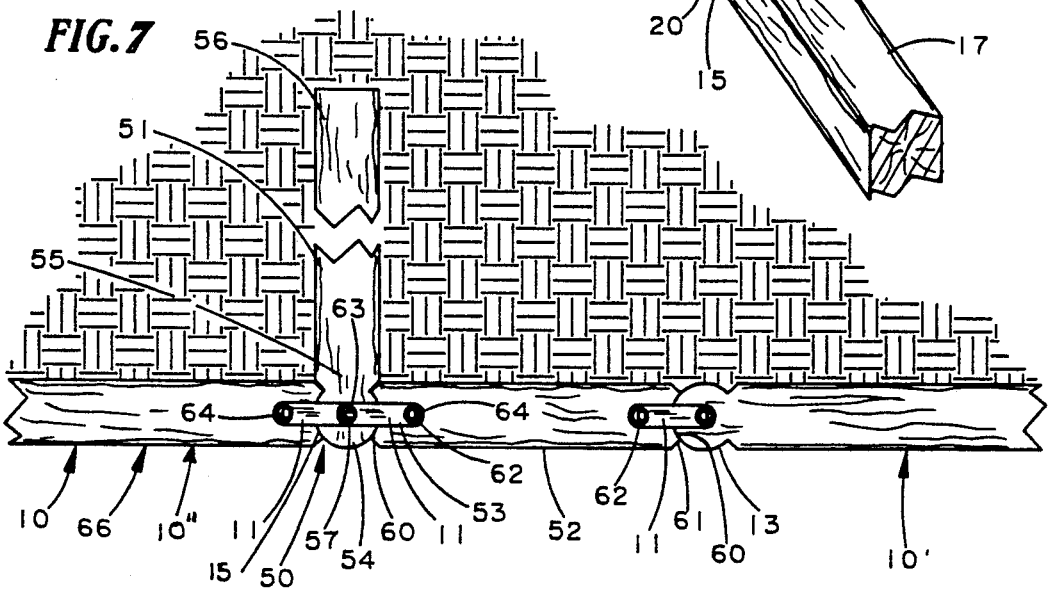
FIG.7
56
51
55
63
64
64
62
62
10
66
10"
11
15
50
57
54
60
11
53
52
11
61
60
13
10'

FIG. 5
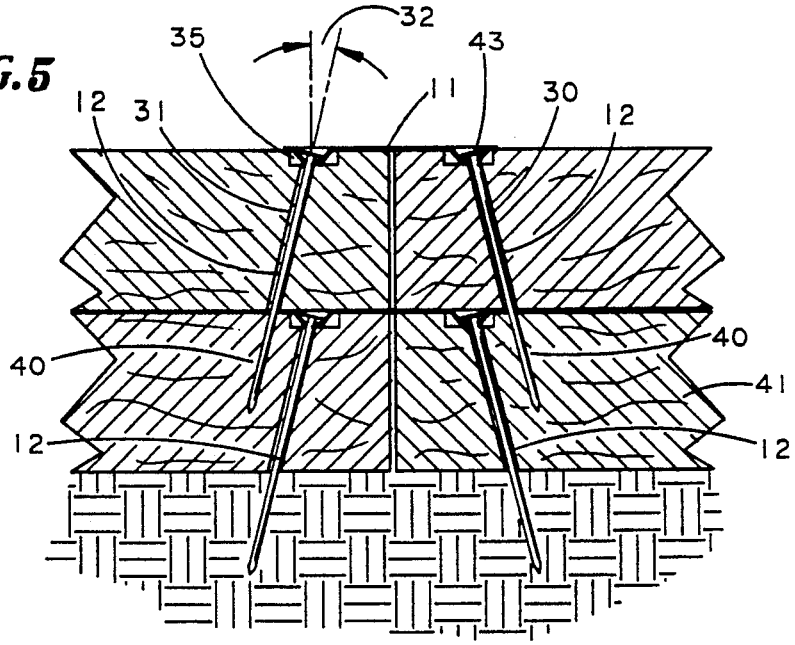
FIG. 4a
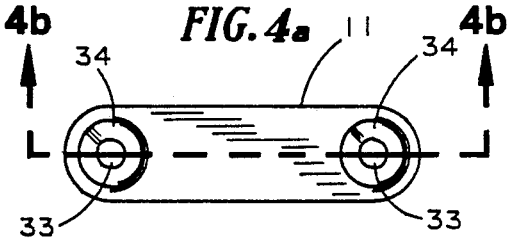
FIG. 4b
FIG. 6
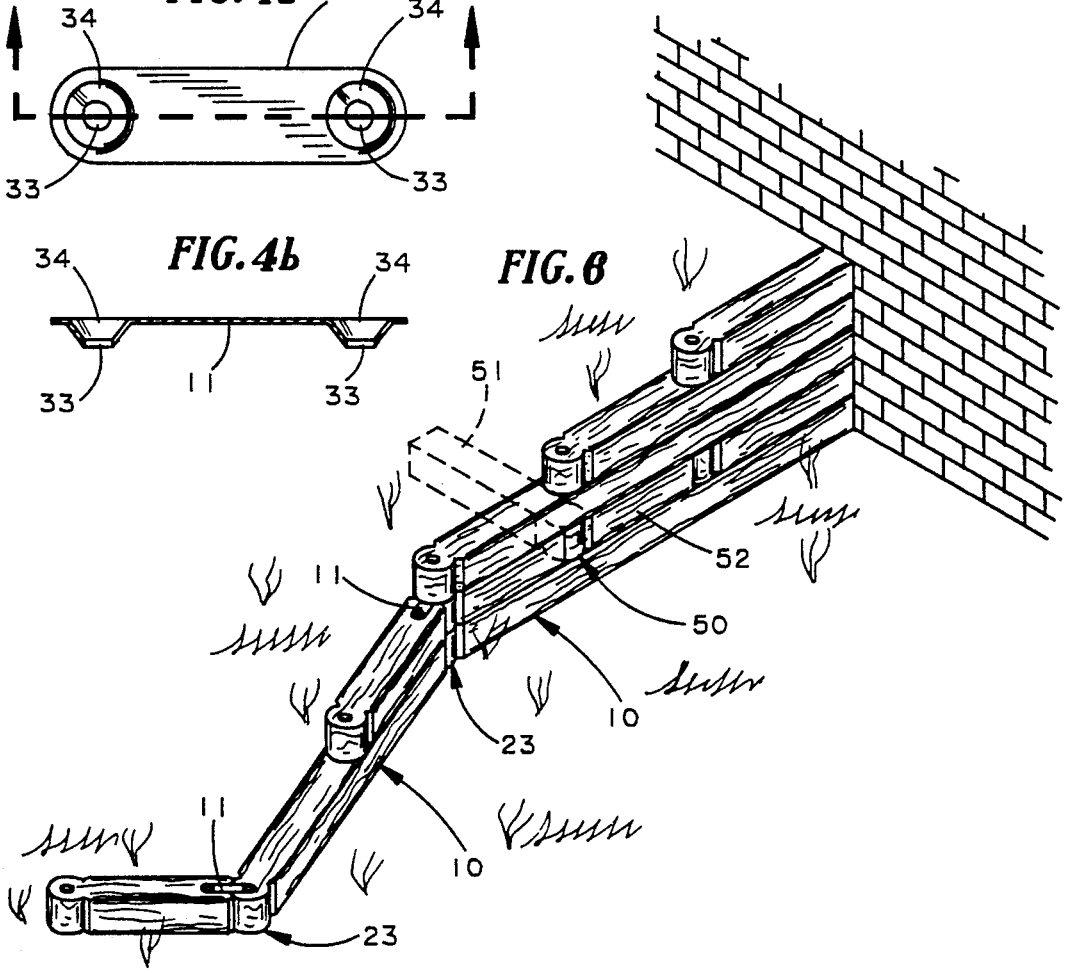

LANDSCAPE TIMBER SYSTEM

BACKGROUND OF THE INVENTION

1. Field of the Invention

This invention relates in general to systems designed to use treated timber for landscape purposes, and more specifically to systems utilizing modular timber units with interconnecting end portions secured with braces and angled spikes and periodic deadman joints to provide overall support.

2. Description of the Prior Art

While the use of treated timber for landscape purposes such as retaining walls or boxed gardens has been known for a considerable period of time, the most common and popular method for installing such timber has remained relatively unchanged and unimproved. Generally, this method requires the timber to be cut at a specific length and many times at angles of less than 90 degrees. Because these cuts are made at the landscape site, they are usually made with a chain saw, a tool which is both dangerous and difficult to operate for the novice. Next, the timber is drilled so that large spikes, lag bolts or other type fasteners can be driven through one piece and into the next piece immediately below for stability. The ultimate problem with this cumbersome process is that it provides for relatively weak and unstable joints, and over a period of time, pressure exerted on these joints will simply cause them to pull apart.

Retaining wall and planter construction systems using modular components are disclosed in U.S. Pat. Nos. 3,343,301 and 4,869,018. While the devices disclosed in these patents utilize a shoulder and socket system to connect the modular units, both rely upon the earth to rigidly secure such joints along with the relative positioning of each unit. Vertically aligned pins used to connect these joints do not, in and of themselves, prevent rotational movement by the units.

A landscaping system utilizing modular timber units is manufactured by Thompson Industries, Inc. Essentially, these units or timbers interconnect with each other through the use of rabbet-type joints with each unit having a male and female end. Once the units are an interlocking position, a wooden dowel may be passed through holes contained in the ends of the adjoining timbers and thus provide some stability to the interlocking joint. However, as with the systems disclosed in the '301 and '018 patents, this dowel does not prevent rotational movement between the interconnected members. Thus, some other stabilizing element is required, such as the earth that is being retained.

SUMMARY OF THE INVENTION

The present invention is a modular unit landscaping system with each unit having a ball joint and socket joint to provide a method to connect adjacent units. The system also utilizes angled spikes and braces to rigidly secure the positioning of such units, and deadman joints to stabilize the generally vertical orientation of a number of units contained in a plurality of vertically aligned layers.

BRIEF DESCRIPTION OF THE DRAWINGS

FIG. 1 is a perspective side view of a modular first member that forms a part of the present invention and has a ball joint and a socket joint.

FIG. 2 is a perspective view of the ends of two linearly connected adjacent first members and their adjoining ball and socket joints.

FIG. 3 is a perspective view of two non-linearly connected adjacent first members.

FIG. 4*a* is a top view of a brace that forms a part of the present invention and has a pair of recessed holes.

FIG. 4*b* is a cross-sectional view taken along the line 4*b*—4*b* of FIG. 4*a*.

FIG. 5 is a cross-sectional side view of two pairs of vertically aligned adjoining members with braces and spikes positioned therein.

FIG. 6 is a perspective view of a sample retaining wall utilizing the modular landscape timber system of the present invention having a plurality of vertically aligned layers.

FIG. 7 is a top view of one vertically aligned layer of a number of first members retaining a portion of earth including a deadman joint having a deadman member and a modular second member.

DETAILED DESCRIPTION OF THE PREFERRED EMBODIMENT

With reference to the drawings, the modular unit landscaping system of the present invention is comprised generally of a plurality of a number of individual components. Such components are an elongated interconnectable modular member 10, a securing brace 11 and a spike 12.

Referring to FIG. 1, the modular member 10 is shown having a ball joint 13 at one end 14, a socket joint 15 at an opposite end 16 and a body portion 17 therebetween. Said modular member 10 is preferably formed from dimensional pretreated lumber; however, other materials such as plastic or rubber may also be used. The cross-sectional dimension of the modular member 10 can be varied as desired to meet the needs of a specific project constructed using the system.

The overall length of the modular member 10 may also be varied and members 10 of differing lengths may be utilized in a single project. Such variance provides a user of the system a significant amount of flexibility. In the preferred embodiment, said members 10 are manufactured to serve as two, four and eight foot modular lengths and to do so each such length has to be one-half inch longer than its desired dimension for the purpose described below.

The ball joint 13 is generally formed by a circular cut at the end 14 which creates notches 20. The socket joint 15 is formed by a concave circular cut at the opposite end 16. End stops 21 are formed at the outer corners of the opposite end 16. The radial arc of the socket joint 15 is generally equal to that of the ball joint 13 so that, as shown in FIGS. 2 and 3, the ball joint 13 of one member 10 precisely fits within the socket joint 15 of an adjacent member 10 to form a joint 23 and as a result of such fit between the ball and socket joints 13 and 15 the extra one-half inch of length of each members 10 is used up in the joint 15 to provide an overall length of two joined members 10 together as being four, eight or sixteen feet. With the ball joint 13 properly placed within the socket joint 15, the joint 23 may be of any desired angle up to 185° in either direction with the end stops 21 designed to prevent further rotational movement by blocking the notches 20.

In order to rigidly secure the joint 23, a first through bore 30 is pre-drilled proximately in the middle of the one end 14 and a second through bore 31 is pre-drilled proximately in the middle of the opposite end 16, as shown in FIG. 5. The first and second through bores 30 and 31 extend from top to bottom of said member 10 on an incline 32 directed away from their respective ends 14 and 16.

The securing brace 11, shown in FIGS. 4*a* and 4*b*, is utilized along with two of the spikes 12 and the through bores 30 and 31 to secure the joint 23. The brace 11 has a pair of oppositely situated holes 33, each set in preferably a concentric recessed dimple 34. The holes 33 are spaced apart in direct relation to the distance between the first and second bores 30 and 31 of the two adjacent ends 14 and 16 forming the joint 23. It should be noted that the distance between said first and second bores 30 and 31 will remain the same regardless of the positioning of the adjacent members 10 that form the joint 23. Thus, when said brace 11 is properly placed the joint 23, the first and second bores 30 and 31 are exposed through said holes 33.

The first and second bores 30 and 31 have a recessed upper opening portion 35. The diameter of each of said recessed portions 35 is slightly larger than the diameter of each of said bores 30 and 31. The recessed portions 35 are also sized to receive the recessed dimples 34 of the brace 11 when the brace 11 is placed on said joint 23, as best depicted in FIG. 5.

With two adjacent members 10 positioned as desired, the brace 11 is then placed on the joint 23. Next, two spikes 12 are driven through the holes 33 and each of said bores 30 and 31 into a solid portion 40 of the members 10 located in a layer 41 of members 10 lying directly beneath said joint 23. With the recessed dimples 34 positioned in the recessed portions 35, as shown in FIG. 5, seats are formed to spike heads 43 when the spikes 12 are completely driven into their associated members 10.

The incline 32 of each bore 30 and 31 allows their associated spikes 12 to provide both horizontal and vertical stability to each joint 23. In contrast, a vertically aligned spike 12 would essentially act as an axis and, allow some rotational movement between adjoining members 10, thereby leading to weak joints 23. The inclined arrangement of the spikes 12 eliminates this problem by avoiding an axial arrangement of such spikes so that rotational movement between adjoining members 10 can only occur upon bending of the spikes 12. It should be noted that the angle of the incline 32 must be sufficient enough to allow the spike 12 to avoid the brace 11 located in the layer 41 directly beneath the joint 23 as shown in FIG. 5.

In the preferred embodiment, the braces 11 are manufactured from either 12–14 gauge or 14–16 gauge cold roll galvanized steel and the spikes utilized are either one-quarter inch or three-eighths inch shank galvanized steel, depending upon the size of the modular members 10 used. However, it is stressed that different materials with differing dimensions may be used.

In many instances, large retaining walls such as that shown in FIG. 6 are constructed using the present invention. When such walls are constructed, it is necessary to provide support to such walls so that they can retain the earth located directly behind. Furthermore, such support is required so that such walls can maintain a generally vertical orientation.

A deadman joint 50 is depicted in FIG. 7 and is comprised of a deadman member 51, a second elongated modular member 52, a deadman brace 53, and spikes 12. The deadman joint 50 is generally used to provide support when constructing a multi-layer retaining wall. The deadman joint 50 provides such support by tying the wall to the earth being retained.

The deadman member 51 has a deadman ball joint 54 at an outer end 55 and a body 56 that is buried in the earth being retained. The deadman ball joint 54 is constructed similarly to and will generally have the same dimensions as those ball joints 13 of members 10 utilized in a particular project. Furthermore, similar to the ball joints 13, said deadman ball joint 54 has a deadman through bore 57 that is preferably inclined.

The second member 52 has generally concave socket joints 60 at its ends 61. The second member 52 also has through bores 62 in the middle of each of its ends 61 situated similarly to said through bores 31 of the members 10.

The deadman joint 50 is generally tied to a layer 66 of members 10 in which it is contained by positioning such joint 50 between two of the modular members 10 contained in the layer 66, which members will be hereafter referred to as 10′ and 10″ for purposes of clarity. The second member 52 is part of the layer 66 and has one of its socket joints 60 receiving the ball joint 13 of the modular member 10′. The deadman ball joint 54 is then positioned between the other socket joint 60 of the second member 52 and the socket joint 15 of the modular member 10″ so that said deadman member 51 is generally situated perpendicular to said layer 66 and extends into the earth being retained. The longitudinal dimension of the second member 52 together with the ball joint 54 preferably form a two-part member having an overall longitudinal dimension generally similar to the longitudinal dimension of one of the first members 10.

One of the socket joints 60 of the second member 52 is adjoined to the ball joint 13 of the member 10′ and is secured to said ball joint 13 in the manner previously described above. The deadman ball joint 54 may be secured to the other of the socket joints 60 of the second member 52 and the socket joint 15 of the member 10″ in a number of different manners. In the preferred embodiment, the deadman brace 53 is formed from two braces 11 utilized in a manner so that one of the holes 33 from each brace 11 overlap to form a middle recessed hole 63. The other holes 33 of each brace are outer recessed holes 64 of the deadman brace 53.

Once the deadman joint 50 is in a desired position, the deadman brace 53 is placed thereon so that the middle hole 63 is positioned to expose the deadman through bore 57, one of the outer holes 64 is positioned to expose the second through bore 31 of the member 10″, and the other outer hole 64 is positioned to expose adjacent the bores 62 of the second member 52. With the deadman brace 53 in such position, three spikes 12 can then be driven through the respective holes 63 and 64 and the respective bores 31, 57 and 62 and into portions of members 10 located in the modular layer directly beneath said deadman joint 50

Another method to secure the deadman joint 50 would not require the use of the brace 53 or spikes 12. Essentially, the static relationship between the deadman ball joint 54 and the adjacent socket joint 15 and 60 would provide a sufficient amount of force to maintain the positioning of the deadman joint 50. It should be obvious to one skilled in the art, however, that there are other methods to secure the deadman joint 50 than those disclosed.

Thus, the present invention provides an efficient and effective modular unit landscaping system for constructing such items as retaining walls and box gardens. Although a specific embodiment has been disclosed herein, it should be well understood by those skilled in the art that numerous modifications can be made to the numerous components of the system without departing from the true spirit and scope of the present invention.

I claim:

1. A modular landscape timber system to serve as a retaining wall for particulate material having a plurality of vertically aligned layers of a number of elongated interconnectable modular members, said system comprising:

(a) each of said members having;
  (i) a generally concave socket joint at one end;
  (ii) a generally circular ball joint at the other end, said ball joint designed to partially fit within said socket joint of an adjacent member;
  (iii) a pre-drilled through bore located proximately in the middle of each end of said member extending from top to bottom on an incline;
(b) a brace for each adjoining ball joint and socket joint having a pair of holes spaced apart in relation to said bores of the adjoining ends of two adjacent members; and
(c) a pair of spikes for each adjoining ball joint and socket joint designed to be driven through the holes of said brace and the bores of said adjoining ends and into a portion of a modular member located in a layer directly beneath said adjacent members.

2. A modular landscape timber system as described in claim 1 wherein said through bore has a recessed upper opening portion having a diameter slightly larger than the diameter of said through bore.

3. A modular landscape timber system as described in claim 1 wherein each of said holes in the brace are set in a recessed dimple designed to mate with said recessed upper openings.

4. A modular landscape timber system as described in claim 1 wherein the angle of said incline is preferably equal to or greater than 10 degrees with respect to a vertical plane.

5. A modular landscape timber system as described in claim 4 wherein said incline is slanted sufficiently so that the spikes avoid any of said braces positioned on the ball joints and socket joints of said layer directly beneath said adjacent members.

6. A modular landscape timber system to serve as a retaining wall for particulate material, said system comprising:

(a) a plurality of vertically aligned layers of a number of first elongated interconnectable modular members, each member having:
  (i) a generally concave socket joint at one end of said member;
  (ii) a generally circular ball joint at the other end of said member, said ball joint designed to partially fit within said socket joint of an adjacent first member;
(b) means to secure said ball joints of said first members to said socket joints of said adjacent first members comprising;
  (i) a through bore located proximately in the middle of each end of said first members extending from top to bottom on an incline;
  (ii) a brace having a pair of holes spaced apart in relation to said bores of two adjoining ends; and
  (iii) a pair of spikes designed to be driven through the holes of said brace and the bores of said adjoining ends and into a portion of a first member located in a layer directly beneath said adjoining ends; and
(c) at least one deadman joint in one layer of said first members to serve as a support for securing said system in a generally vertical orientation, said joint being positioned between two of said first members in said one layer and including:
  (i) a second elongated interconnectable modular member having a generally concave socket joint at each end, said second member located in said one layer with one of its socket joints receiving one of the ball socket joints of one of said two first members in said one layer;
  (ii) an elongated deadman modular member having a generally circular ball joint at one end, said ball joint positioned between the other socket joint of said second member and the socket joint of the other of said two first members so that said deadman member is generally situated perpendicular to said layer and extends into said mound of earth; and
  (iii) means to secure said ball joint of said deadman member to the other socket joint of said second member and said socket joint of said other of said two first members.

7. A modular landscape timber system as described in claim 6 wherein said second member and said ball joint of said deadman member, when coupled together in said deadman joint, form a two-part member having a overall longitudinal dimension generally similar to the overall longitudinal dimension of at least one said first members.

8. A modular landscape timber system as described in claim 7 wherein said means to secure said ball joint of said deadman member to the other socket joint of said second member and said socket joint of said other of said two first members comprises:

(a) an inclined through bore located proximately in the middle of:
  (i) said one end of said deadman member;
  (ii) each end of said second member; and
(b) brace means coacting with a plurality of spikes and said through bores.

9. A modular landscape timber system to serve as a retaining wall for particulate material having a plurality of vertically aligned layers of a number of elongated interconnectable modular members, said system comprising:

(a) each of said members having;
  (i) a generally concave socket joint at one end;
  (ii) a generally circular ball joint at the other end, said ball joint designed to partially fit within said socket joint of an adjacent member;
  (iii) a pre-drilled through bore located proximately in the middle of each end of said member extending from top to bottom on an incline, with a recessed upper opening portion having a diameter slightly larger than the diameter of said through bore;
(b) a brace for each adjoining ball joint and socket joint having a pair of holes spaced apart in relation to said bores of the adjoining ends of two adjacent members, wherein each of said holes in the brace are set in a recessed dimple designed to mate with said recessed upper openings; and (c) a pair of spikes for each adjoining ball joint and socket joint designed to be driven through the holes of said brace and the bores of said adjoining ends and into a portion of a modular member located in a layer directly beneath said adjacent members.

10. A modular landscape timber system as described in claim 9 wherein the length of said elongated members is at least five times greater than either the height or thickness of such members.

11. A modular landscape timber system as described in claim 10 wherein the angle of said incline is preferably equal to or greater than 10 degrees with respect to a vertical plane.

12. A modular landscape timber system as described in claim 11 wherein said incline is slanted sufficiently so that the spikes avoid any of said braces positioned on the ball joints and socket joints of said layer directly beneath said adjacent members.

* * * * *